US005640785A

United States Patent [19]

Egelja

[11] Patent Number: 5,640,785

[45] Date of Patent: Jun. 24, 1997

[54] RESILIENT LOOPS AND MATING HOOKS FOR SECURING FOOTWEAR TO A FOOT

[75] Inventor: Sinisa Egelja, Oceanside, Calif.

[73] Assignee: Items International, Inc., Altoona, Pa.

[21] Appl. No.: 348,054

[22] Filed: Dec. 1, 1994

[51] Int. Cl.[6] ..... A43C 11/00; A43C 1/00; A43B 11/00

[52] U.S. Cl. ..... 36/50.1; 36/51; 24/712

[58] Field of Search ..... 36/50.1, 51, 56; 24/68 SK, 713.9, 712, 713.4, 17 B

[56] References Cited

U.S. PATENT DOCUMENTS

| | | | |
|---|---|---|---|
| 668,408 | 2/1901 | Kalina | 24/712 X |
| 1,798,271 | 3/1931 | Perugia | 36/50.1 X |
| 1,966,135 | 7/1934 | Reh | 36/50.1 |
| 3,193,950 | 7/1965 | Liou | 24/713.9 X |
| 3,731,350 | 5/1973 | Diebold | 24/712 |
| 4,918,840 | 4/1990 | Nardulli | 36/51 X |
| 5,377,430 | 1/1995 | Hatfield et al. | 36/50.1 X |

*Primary Examiner*—BethAnne C. Dayoan

*Attorney, Agent, or Firm*—Reed Smith Shaw & McClay

[57] ABSTRACT

An article of footwear includes a heel, a sole and an upper portion adapted to cover the foot. The upper portion includes a tongue and spaced-apart right and left side portions overlying the tongue. The right and left side portions each respectively define confronting right and left edges. A plurality of hooks are spaced along each of the right and left edges, each of the hooks including an open end facing outwardly from the adjacent confronting edge. A plurality of resilient loops extend from each of the right and left side portions. The resilient loops extending from the right side portion are positioned to engage the hooks spaced along the left edge and the resilient loops extending from the left side portion are positioned to engage the hooks spaced along the right edge.

4 Claims, 5 Drawing Sheets

RESILIENT LOOPS AND MATING HOOKS FOR SECURING FOOTWEAR TO A FOOT

FIELD OF THE INVENTION

This invention relates to footwear, and more particularly to footwear having a novel lacing pattern utilizing resilient loops and hooks.

DESCRIPTION OF THE RELATED PRIOR ART

Conventional footwear has spaced-apart side portions having a series of eyelets presented, in a one-to-one correspondence, along each side portion. An elongated shoelace is utilized which is threaded through the eyelets in various patterns and then tied in bow-like fashion. The shoelace serves to secure the shoe to the foot.

When putting on a shoe, the shoelace must first be loosened, the foot inserted into the footwear, the shoestring is pulled to draw it up tight, and then to tie it. When removing the shoe, it is necessary to untie the bow and then loosen the shoestring before the shoe can be comfortably removed. Children have been known to untie the bow and then force the shoe off of the foot without loosening the shoestring. Such action prematurely wears the shoe.

Conventional footwear also is known wherein the eyelets are replaced by hook-like elements about which the shoestring is laced. Again, when putting on a shoe, it is necessary to loosen the shoestring, to insert the foot into the footwear, lace the shoestring about the hooks, pull the shoestring to draw it up tight and then tie it. When removing the shoe, it is necessary to untie the bow and then loosen the shoestring by unhooking it from a plurality of the hooks before the shoe can be comfortably removed. Children have been known to untie the bow and then force the shoe off of the foot without loosening the shoestring. Such action prematurely wears the shoe.

SUMMARY OF THE INVENTION

The principal object of this invention is to provide footwear having a novel securing system by which the footwear may be readily and rapidly secured to and removed from the foot Another object of this invention is to provide footwear which does not utilize the conventional shoestring as means for tying the footwear.

Still another object of this invention is to provide footwear which incorporates hooks and resilient loops which may be stretched and engaged with the hooks.

In accordance with the present invention, footwear is provided having a sole, a heal and an upper potion adapted to cover the foot. The upper portion includes a tongue and spaced-apart right and left side portions overlying the tongue. The spaced-apart right and left side portions have confronting right and left edges. Hooks are provided which are spaced along each of the confronting right and left edges. The have open ends facing outwardly of the adjacent confronting edge. Flexible loops are provided extending from the right and left side portions. The arrangement is such that each of the flexible loops of the right side portion are positioned to engage the hook disposed on the left side edge of the left side portion, and each of the flexible loops of the left side portion are positioned to engage the hook disposed on the right side edge of said right side portion.

In one embodiment, the flexible loops may extend from the confronting right and left edges. In a second embodiment, the flexible loops may extend from right and left seams disposed between the sole and each of the confronting right and left edges. In a third embodiment, the flexible loops may extend from the juncture of the heel/sole and the upper portion on each side of the footwear.

DESCRIPTION OF PRESENTLY PREFERRED EMBODIMENT(S)

Figure 1:
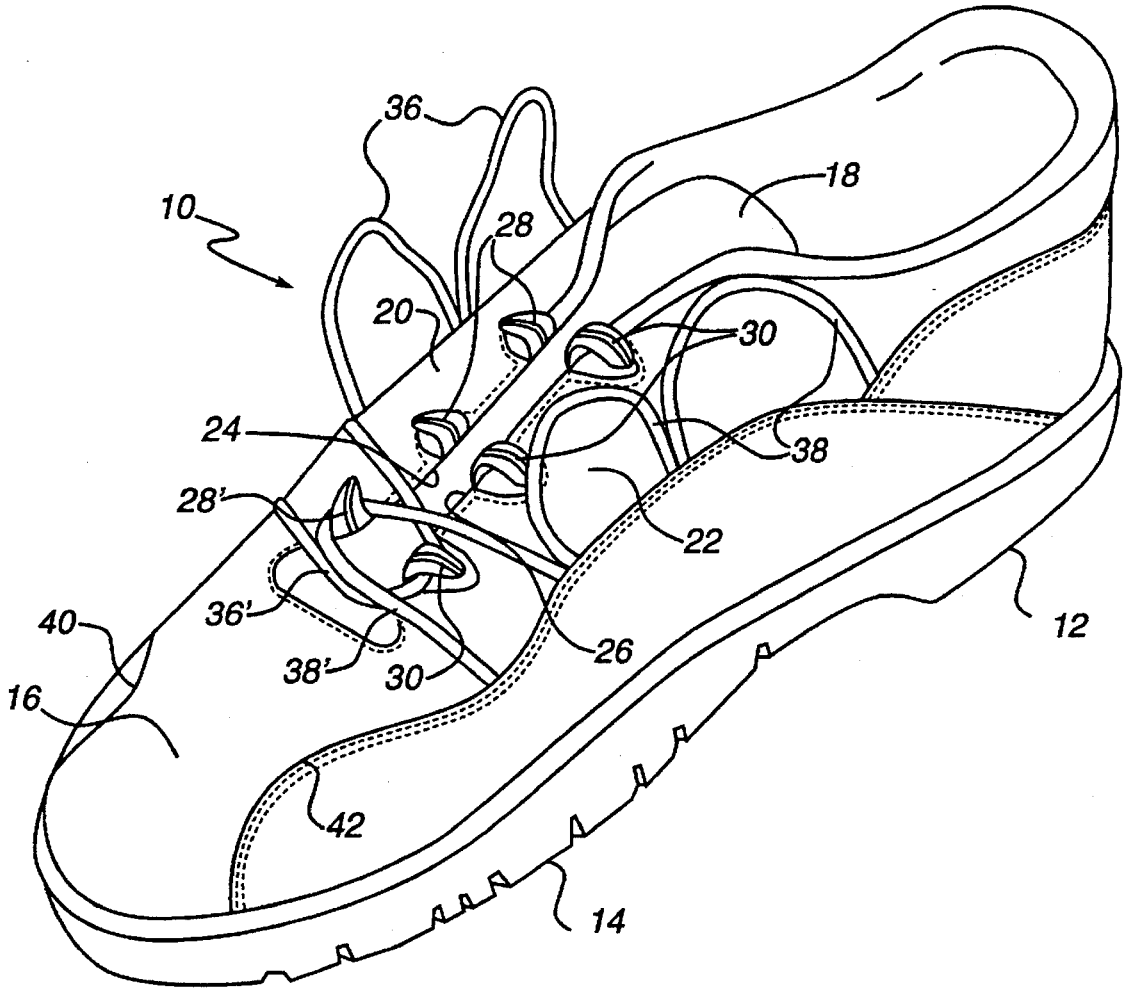
FIG. 1 is an isometric view footwear for the left foot, illustrating flexible loops both engaged with hooks and disengaged from hooks.
Figure 2:
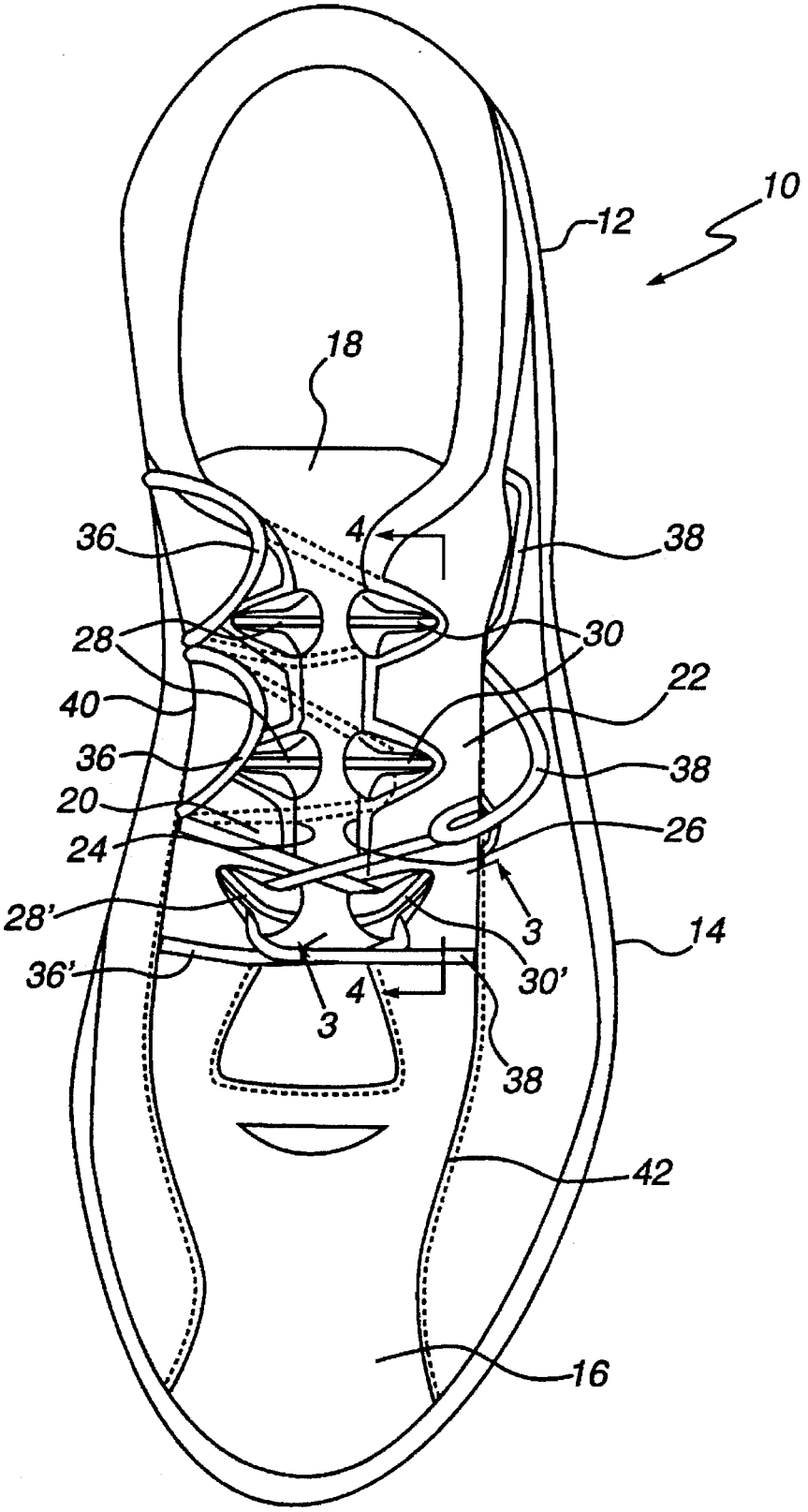
FIG. 2 is a plan view of the footwear of FIG. 1.

Referring to FIGS. 1 and 2, footwear 10 is illustrated having a heal 12, a sole 14 and an upper portion 16 adapted to cover the foot. In this instance, the footwear 10 is for the left foot. Footwear for the right foot is of a similar construction.

The upper portion 16 includes a tongue 18 and right and left side portions 20, 22 which overly the tongue 18. The right and left side portions 20, 22 present confronting right and left edges 24, 26. Right hooks 28 are spaced along the right edge 24 whereas left hooks 30 are spaced along the left edge 26.

In accordance with the present invention, right and left loops 36, 38 are provided, each preferably formed from elastic material so that each may be stretched to engage one of the hooks 28, 30. The resilient loops 36, 38 extend from seams 40, 42 which extend along both sides of the upper portion 16 and are spaced from the heel/sole 12,14 and the confronting right and left edges 24, 26. Thus the resilient right loops 38 are positioned to engage the left hook 30 dispose along the left side edge 26 of the left side portion 22. Similarly, the left resilient loops 38 are positioned to engage the right hook 28 disposed along the right side edge 24 of the right side portion 20. As shown, for example, the right resilient loop 36' is engaged with the left hook 30' and the left resilient loop 38' is engaged with the right hook 28'.

Figure 3:
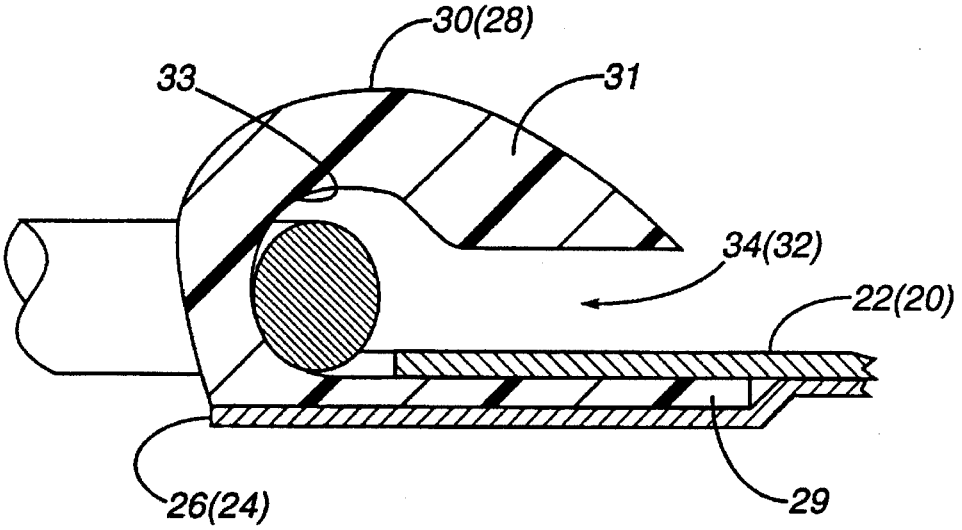
FIG. 3 is a cross-sectional view taken along the line 3—3 of FIG. 2, illustrating a hook.

The following explanation is directed to FIG. 3 which illustrates the hook 30 provided on the left edge 26. It is to be understood that the identical explanation is applicable to the right hooks 28. Therefore, in FIGS. 3 and 4, elements are identified as by double numerals, for example, the left and right hooks 30(28).

Figure 4:
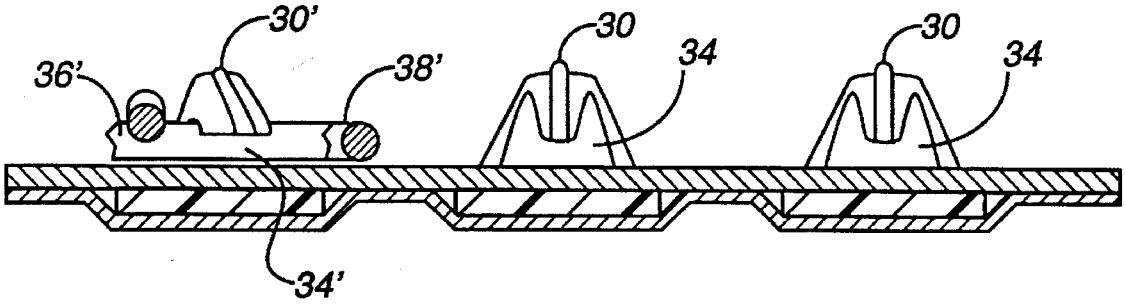
FIG. 4 is a cross-sectional view taken along the line 4—4 of FIG. 2 illustrating a series of the hooks.

Each hook 30(28) includes a base 29 secured to the side portion 22(20) and an arcuate upper portion 31 which cooperates with the base 29 to define an open end 34(32) providing access to the interior space 33. Each open end 34(32) faces outwardly of the adjacent confronting edge 26(24). Also as shown in FIG. 4, the right resilient loop 36' is received through the open end 34' of the left hook 30'. With all of the resilient loops 36, 38 engaged with the hooks 30, 28, respectively, the footwear is firmly secured to the individual's foot (not illustrated). It should also be evident that with all of the resilient loops 36, 38 disengaged from the corresponding hooks 30, 28, the tongue 18 may be raised thereby spreading the side portions 20, 22 to provide a larger-than-normal opening for the introduction of the foot into the footwear.

Alternative embodiments of the present invention are schematically illustrated in FIG. 5 to 8. Corresponding numerals will be employed to identify corresponding parts heretofore described.

Figure 5:
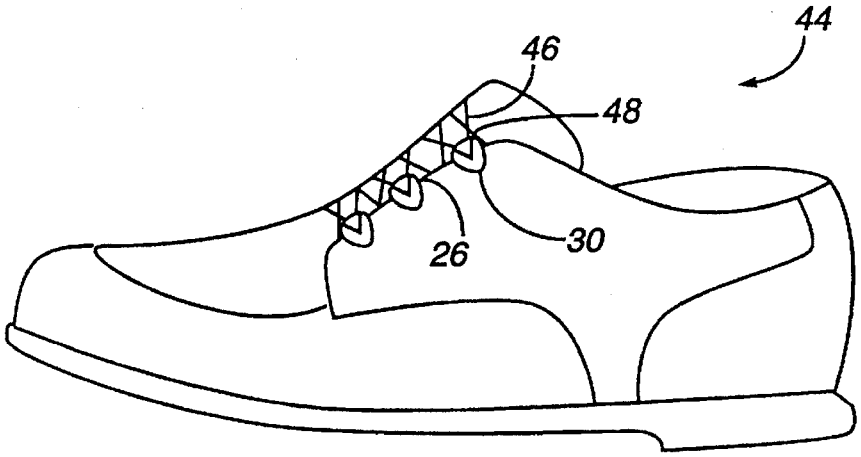
FIG. 5 is a side view of footwear for the left foot, illustrating another embodiment of the loop and hook arrangement of this invention.
Figure 6:
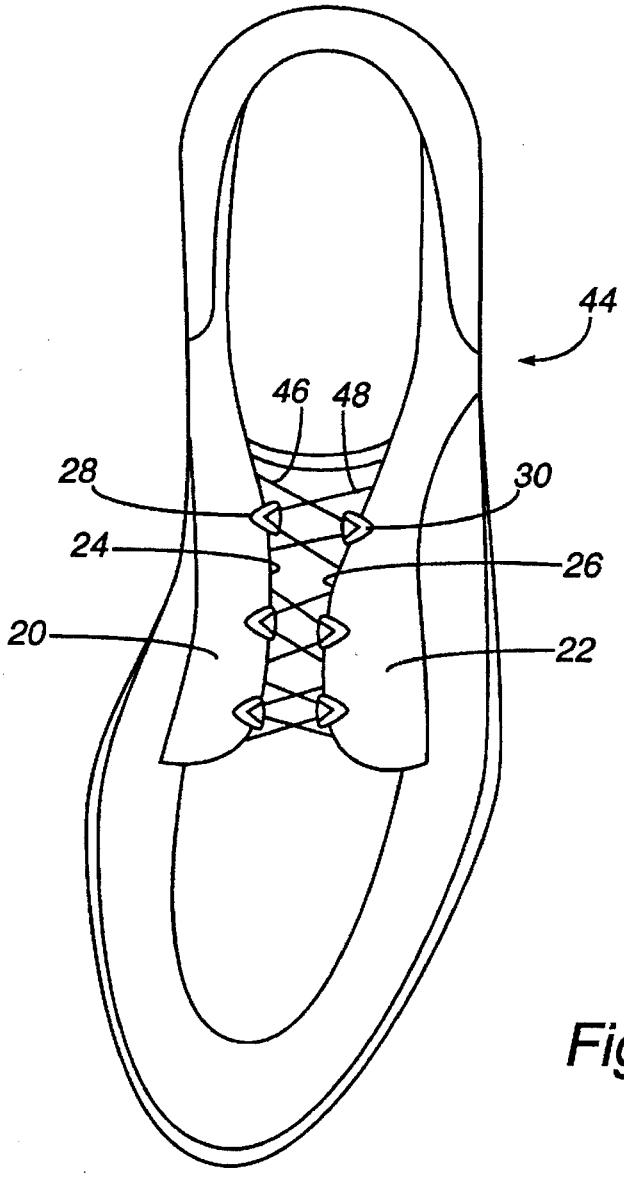
FIG. 6 is a plan view of the footwear of FIG. 5.

Referring to FIGS. 5 and 6, footwear 44 is illustrated wherein right and left resilient loops 46, 48 extend from the confronting right and left edges 24, 26 of the right and left side portions 20, 22. The right resilient loops 46 are positioned to engage the left hooks 30 provided along the left edge 26, whereas the left resilient loops 48 are positioned to engage the right hooks 28 provided along the right edge 24. Again, the resilient loops 46, 48 may be quickly attached and detached from the corresponding hooks 30, 28.

Figure 7:
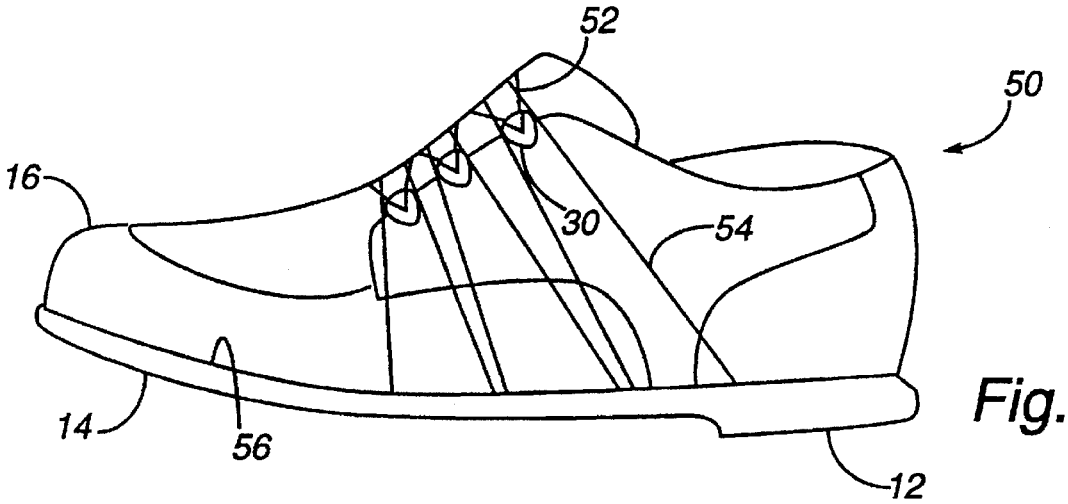
FIG. 7 is a side view of footwear for the left foot, illustrating still another embodiment of the loop and hook arrangement of this invention.
Figure 8:
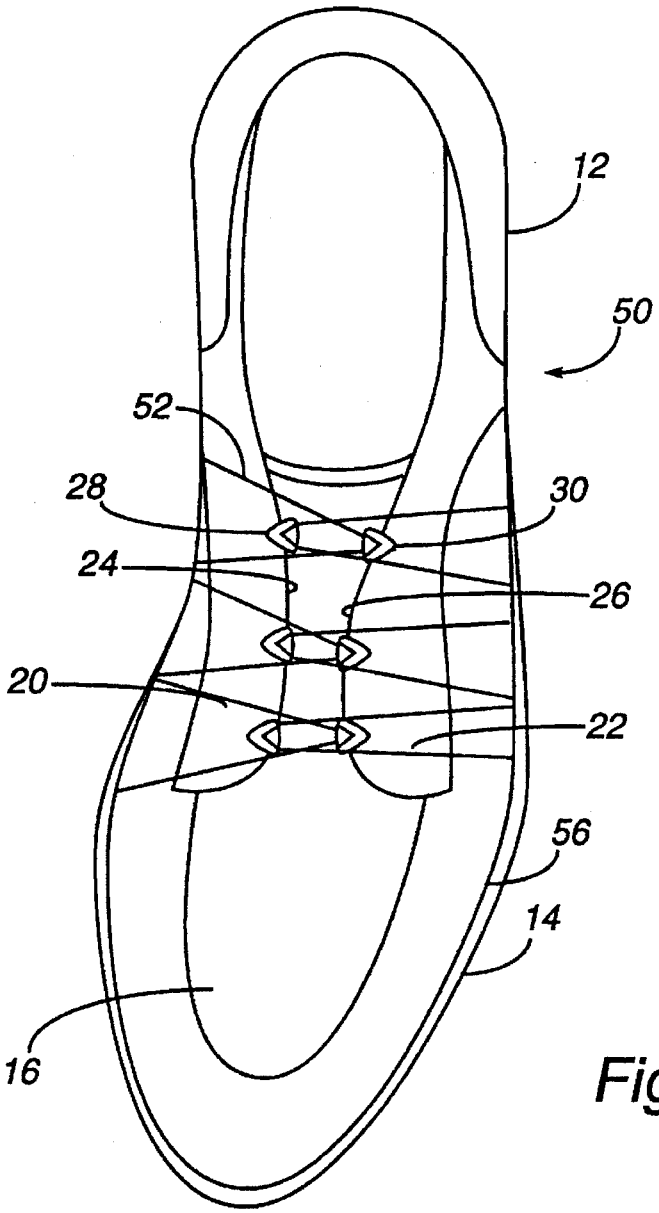
FIG. 8 is a plan view of the footwear of FIG. 7.

Referring to FIGS. 7 and 8, footwear 50 is illustrated wherein right and left resilient loops 52, 54 extend from the juncture 56 of the upper portion 16 and the heel and sole 12, 14 on the right and left side of the footwear 50. The right resilient loops 52 are positioned to engage the left hooks 30 provided along the left edge 26 of the left side portion 22, whereas the left resilient loops 54 are positioned to engage the right hooks 28 provided along the right edge 24 of the right side portion 20. Again, the resilient loops 52, 54 may be quickly attached and detached from the corresponding hooks 30, 28.

I claim:

1. A footwear comprising a sole and an upper portion connected to the sole and adapted to cover a foot, the upper portion comprising:

a tongue;

right and left side portions overlying said tongue, each of the right and left side portions respectively having a confronting right and left edge;

a seam disposed along the upper portion intermediate of the respective confronting right and left edges of said right and left side portions and the sole;

at least one hook disposed on each of the confronting right and left edges, said at least one hook having an open end facing in a direction away from the respective confronting edge; and at least one resilient loop connected to each of said right and left side portions at each said seam, said at least one resilient loop connected to said right side portion positioned to engage said at least one hook disposed on the left edge, and said at least one resilient loop connected to said left side portion positioned to engage said at least one hook disposed on the right edge.

2. The footwear of claim 1 wherein said at least one hook comprises a plurality of hooks, and further wherein said at least one resilient loop comprises a plurality of resilient loops complimentary to the plurality of hooks.

3. A footwear comprising a sole and an upper portion connected to the sole to form a juncture therebetween, the upper portion comprising:

a tongue;

right and left side portions overlying said tongue, each of the right and left side portions respectively having a confronting right and left edge;

at least one hook disposed on each of the confronting right and left edges, said at least one hook having an open end facing in a direction away from the respective adjacent edge; and at least one resilient loop connected to each of said right and left side portions at the juncture between the sole and the upper portion, said at least one resilient loop connected to said right side portion positioned to engage said at least one hook disposed on the left edge, and said at least one resilient loop connected to said left side portion positioned to engage said at least one hook disposed on the right edge.

4. The footwear of claim 3 wherein said at least one hook comprises a plurality of hooks, and further wherein said at least one resilient loop comprises a plurality of resilient loops complimentary to the plurality of hooks.

* * * * *